US011026547B2

(12) United States Patent
Arndt

(10) Patent No.: US 11,026,547 B2
(45) Date of Patent: Jun. 8, 2021

(54) CHILD TOILET SEAT ASSEMBLY

(71) Applicant: Bemis Manufacturing Company, Sheboygan Falls, WI (US)

(72) Inventor: Jonathan Arndt, Sheboygan, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 71 days.

(21) Appl. No.: 16/226,901

(22) Filed: Dec. 20, 2018

(65) Prior Publication Data

US 2019/0191943 A1 Jun. 27, 2019

Related U.S. Application Data

(60) Provisional application No. 62/609,673, filed on Dec. 22, 2017.

(51) Int. Cl.

| | |
|---|---|
| ***A47K 13/06*** | (2006.01) |
| ***A47K 13/26*** | (2006.01) |
| ***A47K 13/24*** | (2006.01) |
| ***A47K 13/12*** | (2006.01) |

(52) U.S. Cl.

CPC ..... *A47K 13/06* (2013.01); *A47K 13/12* (2013.01); *A47K 13/24* (2013.01); *A47K 13/26* (2013.01); *E05Y 2900/614* (2013.01)

(58) Field of Classification Search

CPC ..... A47K 13/06; A47K 13/12; A47K 13/245; E05Y 2900/614; E05D 11/1007; E05D 11/105; E05D 11/1014

USPC ..... 4/246.1

See application file for complete search history.

(56) References Cited

U.S. PATENT DOCUMENTS

| | | | |
|---|---|---|---|
| 722,465 | A | 3/1903 | Sudbrink |
| 756,897 | A | 4/1904 | Rutledge |
| 1,194,972 | A | 8/1916 | Dunn |
| 1,701,114 | A | 2/1929 | McKinney, Jr. |

(Continued)

FOREIGN PATENT DOCUMENTS

| | | | |
|---|---|---|---|
| GB | 2069562 | A | 8/1981 |
| GB | 2266900 | A | 11/1993 |

(Continued)

OTHER PUBLICATIONS

Cool Bath Design LLC, "Xpress Trainer Pro-All in One-Real Simple Potty Training Round/Standard Family Toilet Seat," <https://www.amazon.com/Trainer-One-Real-Training-Round-Standard/dp/B0012BWUDQ> webpage accessed Dec. 4, 2017.

(Continued)

*Primary Examiner* — Erin Deery

(74) *Attorney, Agent, or Firm* — Michael Best & Friedrich LLP

(57) ABSTRACT

A child toilet seat assembly includes a base member configured to be coupled to an adult toilet seat assembly having an adult toilet seat and a lid pivotably coupled to a hinge post. The child toilet seat assembly also includes a child toilet seat coupled to the base member via a hinge joint. The hinge joint enables the child toilet seat to pivot about a pivot axis between an operating position and a storage position. The hinge joint also enables the child toilet seat to move along a translational axis between a locked state inhibiting movement of the child toilet seat relative to the base member and an unlocked state allowing movement of the child toilet seat relative to the base member.

23 Claims, 8 Drawing Sheets

(56) References Cited

U.S. PATENT DOCUMENTS

| | | | | |
|---|---|---|---|---|
| 1,701,115 | A | 2/1929 | McKinney, Jr. | |
| 1,894,387 | A | 1/1933 | Weis | |
| 2,221,991 | A | 11/1940 | Myers et al. | |
| 2,692,992 | A | 11/1954 | Thimmes et al. | |
| 2,693,602 | A | 11/1954 | Meath | |
| 2,712,653 | A | 7/1955 | Nika et al. | |
| 2,721,531 | A | 10/1955 | Findley, Jr. | |
| 2,765,949 | A | 10/1956 | Hillman | |
| 2,820,969 | A | 1/1958 | Wedge | |
| 2,850,744 | A | 9/1958 | Nika et al. | |
| 3,590,402 | A | 7/1971 | Penley | |
| 3,609,775 | A | 10/1971 | Leiter et al. | |
| 3,653,077 | A | 4/1972 | Warnberg | |
| 4,133,061 | A | 1/1979 | Hurd | |
| 4,246,666 | A | 1/1981 | Stansbury, Jr. | |
| 4,404,695 | A | 9/1983 | Camp | |
| 4,461,046 | A * | 7/1984 | Adams | A47K 13/06 4/235 |
| 4,516,279 | A | 5/1985 | Block | |
| 4,680,816 | A | 7/1987 | Colombani | |
| 4,724,551 | A | 2/1988 | Gardner | |
| D309,176 | S | 7/1990 | Sessions | |
| 5,182,818 | A | 2/1993 | Nawoj | |
| 5,267,357 | A | 12/1993 | Ades | |
| 5,363,509 | A | 11/1994 | Evans | |
| 5,384,917 | A | 1/1995 | Epling | |
| D359,798 | S | 6/1995 | Barrett et al. | |
| 5,448,781 | A | 9/1995 | Miller | |
| 5,608,921 | A | 3/1997 | Barrett et al. | |
| 5,666,672 | A | 9/1997 | Birsel et al. | |
| 5,685,023 | A | 11/1997 | Alston | |
| 5,749,104 | A | 5/1998 | Evans | |
| 5,794,277 | A | 8/1998 | Jones | |
| 5,937,449 | A * | 8/1999 | Rey | A47K 13/242 4/246.1 |
| D423,655 | S | 4/2000 | Otte | |
| D434,839 | S | 12/2000 | Hulsebus et al. | |
| D437,921 | S | 2/2001 | Hulsebus et al. | |
| 6,189,159 | B1 | 2/2001 | Bailey et al. | |
| 6,233,784 | B1 | 5/2001 | Daoud | |
| D448,459 | S | 9/2001 | Hulsebus et al. | |
| D449,674 | S | 10/2001 | Otte et al. | |
| 6,449,780 | B1 * | 9/2002 | Merry | A47K 13/06 4/235 |
| D470,231 | S | 2/2003 | Otte et al. | |
| 6,952,842 | B2 | 8/2005 | Courtney | |
| D510,616 | S | 10/2005 | Regan | |
| 7,093,308 | B2 | 8/2006 | Berlovan et al. | |
| D593,656 | S | 6/2009 | De Lay | |
| D593,657 | S | 6/2009 | De Lay | |
| 9,204,768 | B2 | 12/2015 | Green et al. | |
| 9,414,723 | B2 | 8/2016 | Capraro et al. | |
| 9,775,475 | B2 * | 10/2017 | Falk | A47K 13/10 |
| 9,814,360 | B2 | 11/2017 | Gray et al. | |
| 2003/0097708 | A1 | 5/2003 | Zhang | |
| 2004/0064876 | A1 | 4/2004 | Lu | |
| 2005/0246862 | A1 | 11/2005 | Chen | |
| 2010/0115688 | A1 | 5/2010 | Mauduit | |
| 2013/0212793 | A1 | 8/2013 | Hand | |
| 2015/0327737 | A1 | 11/2015 | Fitch et al. | |

FOREIGN PATENT DOCUMENTS

| | | | |
|---|---|---|---|
| JP | S62-106595 | U | 7/1987 |
| JP | H03-127597 | U | 12/1991 |
| KR | 20040010901 | A | 2/2004 |

OTHER PUBLICATIONS

Bemis, "NextStep Children's Round Closed Front Toilet Seat in White," <https://www.homedepot.com/p/BEMIS-NextStep-Children-s-Round-Closed-Front-Toilet-Seat-in-White-583SLOWA-000/206113101> webpage accessed Dec. 4, 2017.

European Patent Office Extended Search Report for Application No. 18215313.0 dated Apr. 18, 2019 (8 pages).

Examination Report issued by Intellectual Property India for Application No. 201814048462, dated Jan. 29, 2020 (7 pages including English translation).

* cited by examiner

CHILD TOILET SEAT ASSEMBLY

CROSS-REFERENCE TO RELATED APPLICATIONS

This application claims priority to U.S. Provisional Patent Application No. 62/609,673 filed on Dec. 22, 2017, the contents of which are incorporated herein by reference.

FIELD OF THE INVENTION

The present invention relates to toilet seat assemblies and, more particularly, to a child toilet seat assembly coupled to an adult toilet seat assembly.

SUMMARY

In one aspect, a child toilet seat assembly includes a base member configured to be coupled to an adult toilet seat assembly having an adult toilet seat and a lid pivotably coupled to a hinge post. The child toilet seat assembly also includes a child toilet seat coupled to the base member via a hinge joint. The hinge joint enables the child toilet seat to pivot about a pivot axis between an operating position and a storage position. The hinge joint also enables the child toilet seat to move along a translational axis between a locked state inhibiting movement of the child toilet seat relative to the base member and an unlocked state allowing movement of the child toilet seat relative to the base member.

In another aspect, the base member is configured to be coupled to the lid of the adult toilet seat assembly.

In another aspect, the base member is configured to be selectively coupled to the lid.

In another aspect, the pivot axis is a child seat pivot axis, the child toilet seat is configured to pivot about the child seat pivot axis when the child toilet seat is in the unlocked state, and the child toilet seat is configured to pivot about an adult seat pivot axis when the child toilet seat is in the locked state.

In another aspect, the hinge joint includes a protrusion formed on one of the base member and the child toilet seat, the hinge joint also includes a recess formed in the other one of the base member and the child toilet seat, and the protrusion is received within the recess enabling the child toilet seat to pivot about the pivot axis and to move along the translational axis.

In another aspect, one of the protrusion and the recess includes a tab, the other one of the protrusion and the recess includes a notch, the tab is received within the notch when the child toilet seat is in the locked state, and the tab is spaced from the notch when the child toilet seat is in the unlocked state.

In another aspect, the base member includes a step and the child toilet seat includes a lip, the lip is engageable with the step when the child toilet seat is in the locked state, and the lip is spaced from the step when the child toilet seat is in the unlocked state.

In another aspect, a child toilet seat assembly includes a base member configured to be coupled to an adult toilet seat assembly having an adult toilet seat and a lid pivotably coupled to a hinge post. The child toilet seat assembly also includes a child toilet seat having a support surface configured to support a person, a protrusion coupled to one of the base member and the child toilet seat, and a recess formed within the other one of the base member and the child toilet seat. The protrusion is received within the recess enabling the child toilet seat to pivot about a pivot axis relative to the base member between an operating position and a storage position. The protrusion is slidable within the recess between a locked state inhibiting movement of the child toilet seat relative to the base member and an unlocked state allowing movement of the child toilet seat relative to the base member.

In another aspect, a toilet seat system includes an adult toilet seat pivotable about a first pivot axis, a lid pivotable about the first pivot axis, and a child toilet seat pivotable about a second pivot axis different than the first axis between an operating position and a storage position. The child toilet seat is also moveable along a translational axis between a locked state inhibiting pivotable movement of the child toilet seat relative to the lid and an unlocked state allowing pivotable movement of the child toilet seat relative to the lid.

In another aspect, the child toilet seat is configured to pivot about the first pivot axis when the child toilet seat is in the locked state, and the child toilet seat is configured to pivot about the second pivot axis when the child toilet seat is in the unlocked state.

In another aspect, a base member is coupled to the lid and the child toilet seat, and the base member and the child toilet seat define a hinge joint enabling the child toilet seat to move about the first pivot axis, the second pivot axis, and along the translational axis.

Any of the above referenced aspects of the invention can be combined with any one or more of the above referenced aspects of the invention.

In addition, other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and being practiced or being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
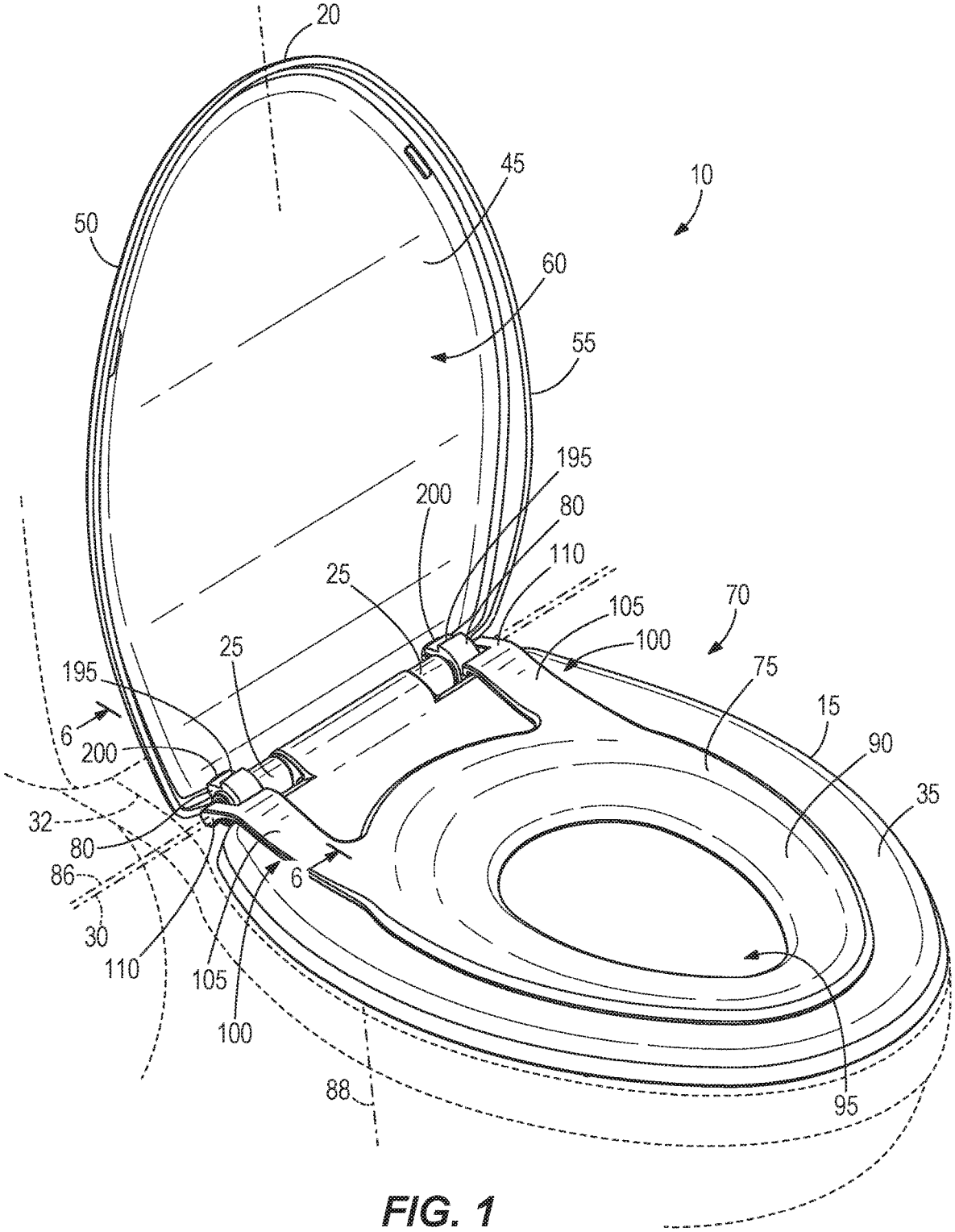
FIG. 1 is a perspective view of a toilet seat system including a child toilet seat assembly coupled to an adult toilet seat assembly in an operating position.
Figure 4:
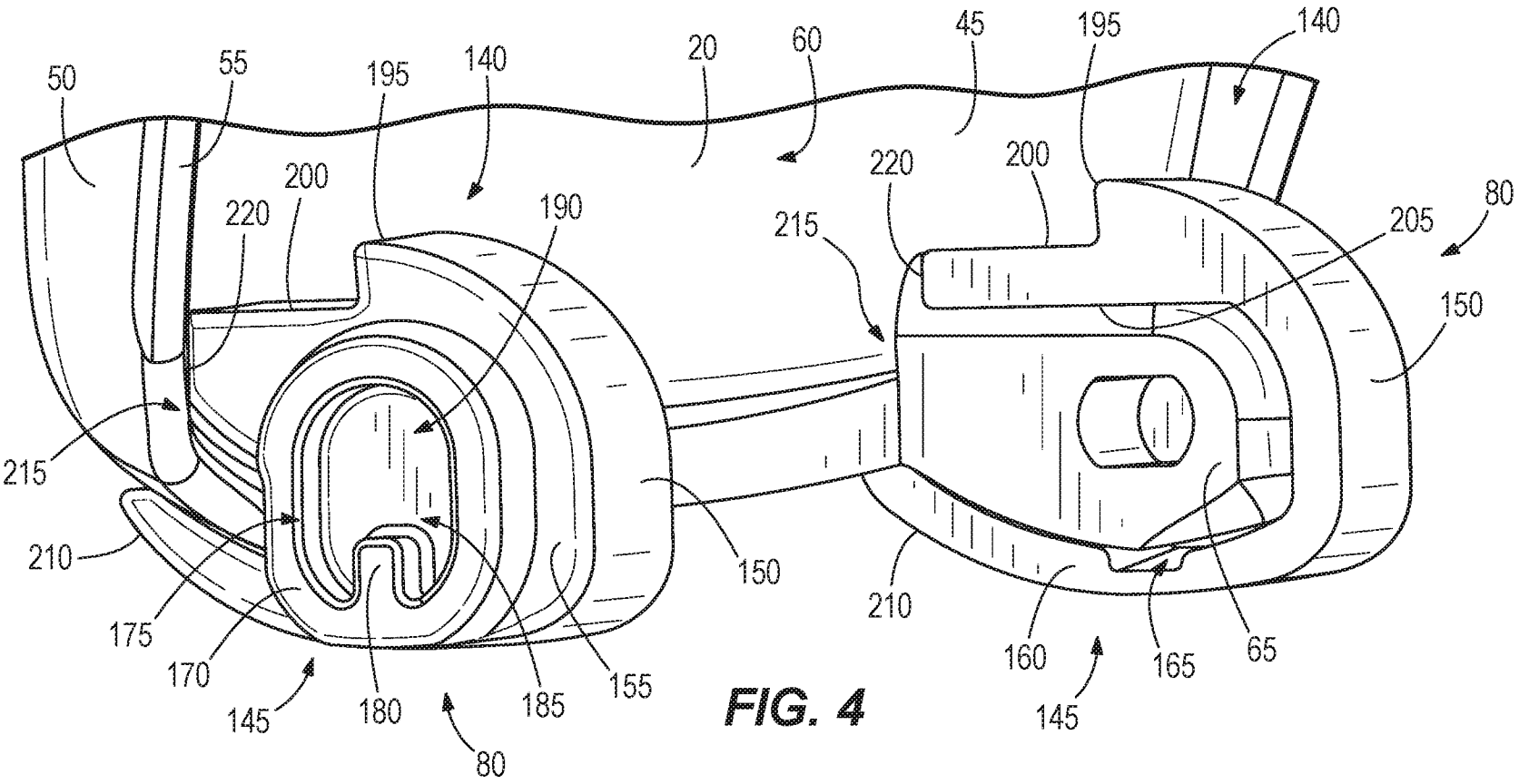
FIG. 4 is a perspective view of base members of the child toilet seat assembly coupled to a lid of the adult toilet seat assembly.
Figure 5:
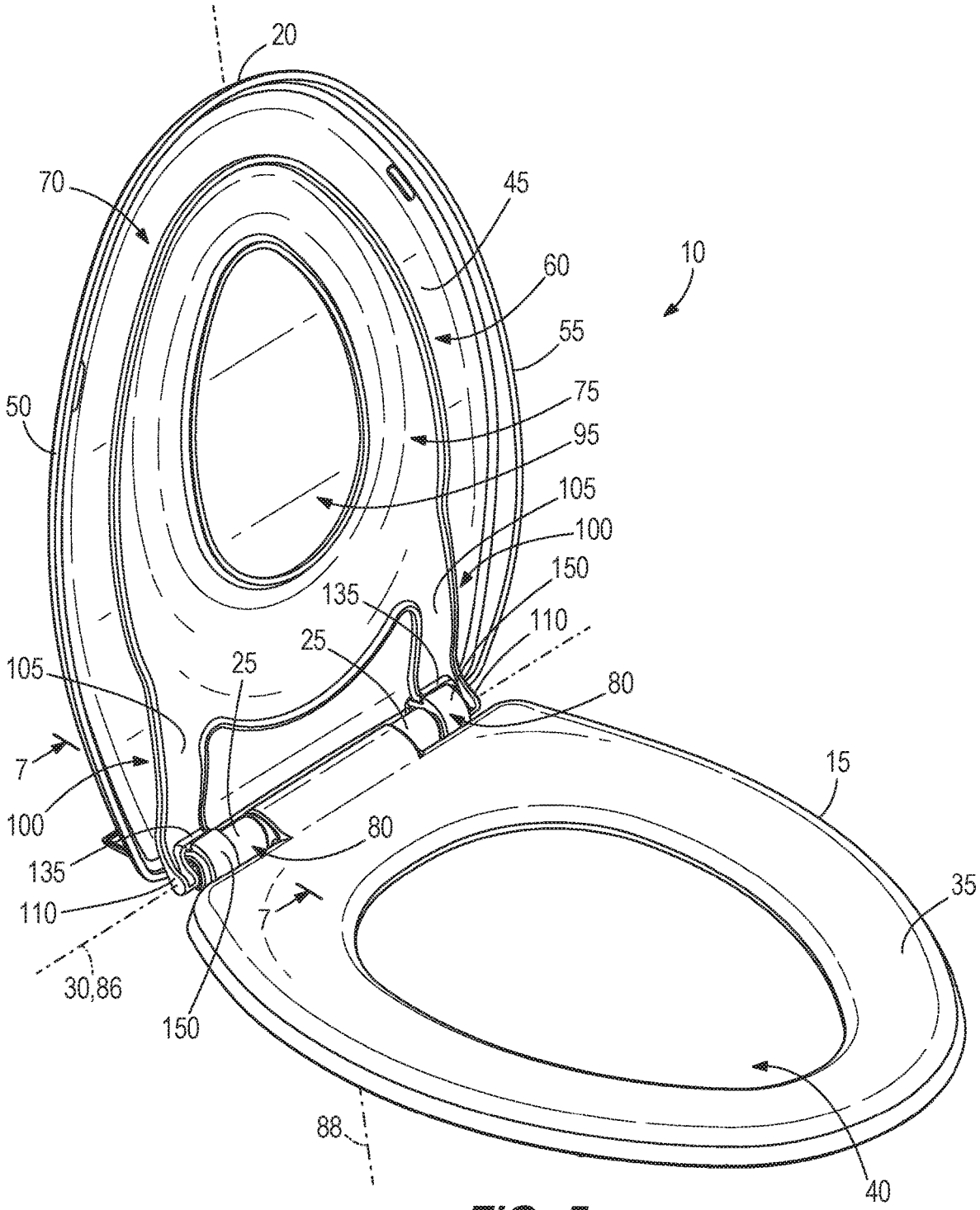
FIG. 5 is a perspective view of the child toilet seat assembly coupled to the adult toilet seat assembly in a storage position.

FIG. 1 illustrates an adult toilet seat assembly 10 including an adult seat 15 and a lid 20 pivotably coupled to two hinge posts 25 about a first or adult pivot axis 30. The hinge posts 25 are fixed to a toilet bowl 32 so that the adult seat 15 and the lid 20 are independently moveable about the adult pivot axis 30 relative to the toilet bowl 32. In other embodiments, the adult toilet seat assembly 10 can include one hinge post to which the adult seat 15 and the lid 20 are pivotably coupled. The illustrated adult seat 15 includes an adult support surface 35 adapted to support an adult above the toilet bowl 32 with the adult support surface 35 forming an adult seat opening 40 (FIG. 5). The illustrated lid 20 includes a bottom surface 45, a top surface 50, and an edge 55 positioned between the bottom surface 45 and the top surface 50. The bottom surface 45 and the edge 55 define a recessed portion 60 of the lid 20. The lid 20 also includes arms 65 (FIG. 4) that allow attachment of the lid 20 to the hinge posts 25. In the illustrated embodiment, the hinge posts 25 are positioned between the arms 65 along the adult pivot axis 30. In other embodiments, one or both arms 65 can be positioned between the hinge posts 25. In further embodiments, the lid 20 can include one arm 65 that allows attachment of the lid 20 to the hinge post(s) 25.

Figure 2:
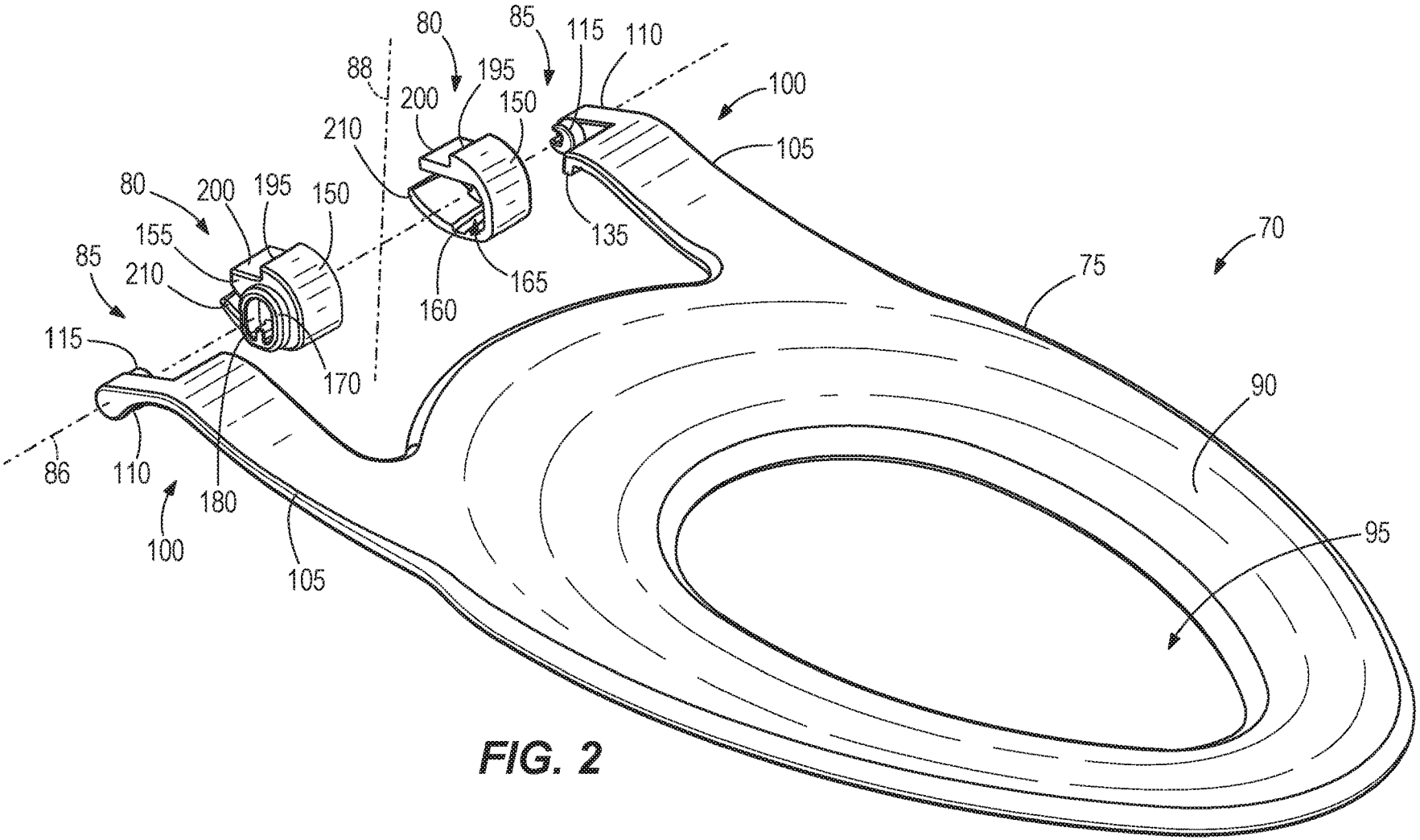
FIG. 2 is an exploded view of the child toilet seat assembly.
Figure 3:
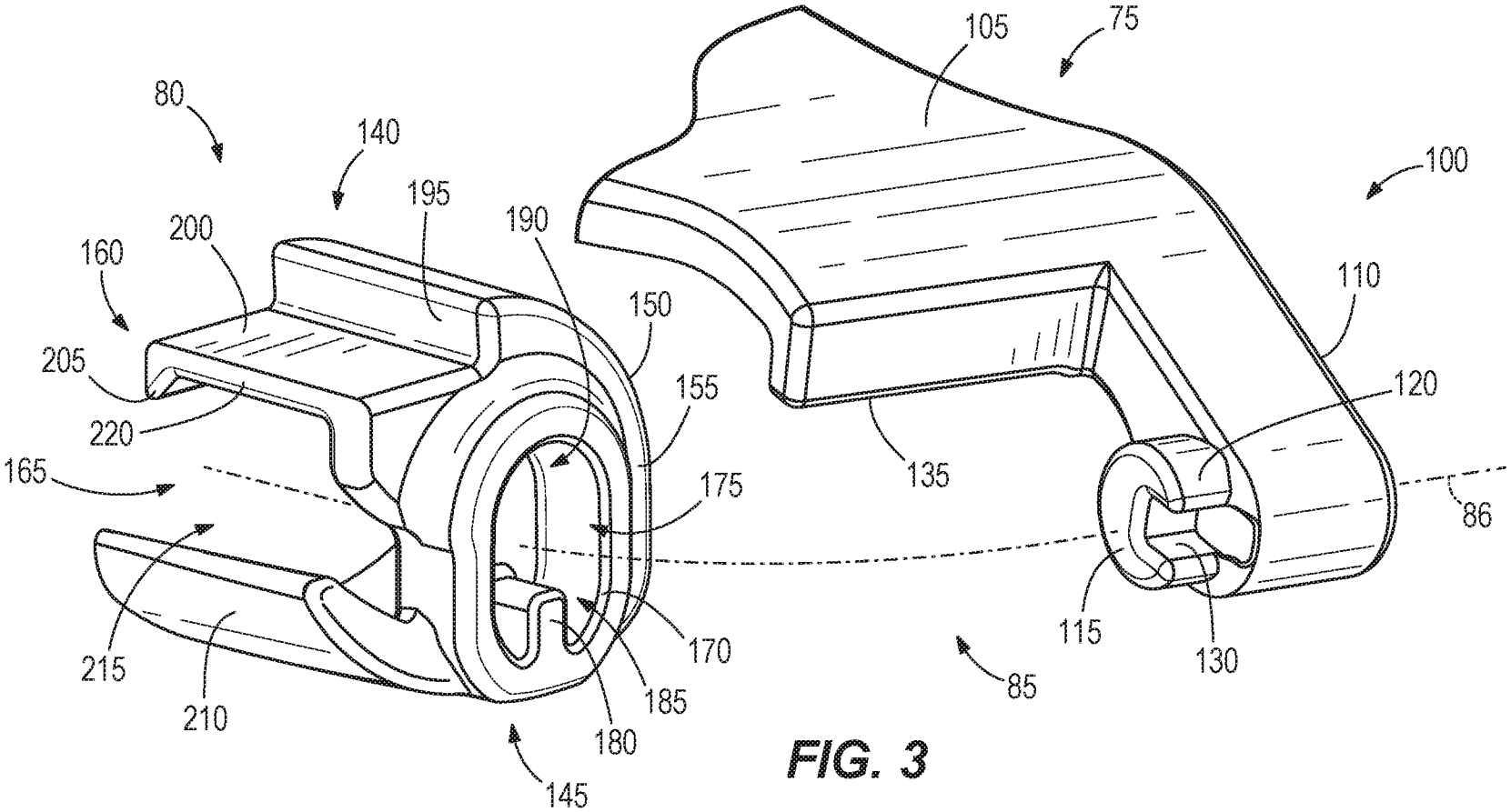
FIG. 3 is an exploded view of a portion of the child toilet seat assembly.

With continued reference to FIG. 1, a child toilet seat assembly 70 is selectively coupled to the adult toilet seat assembly 10. Collectively, the adult toilet seat assembly 10 and the child toilet seat assembly 70 can be referred to as a toilet seat system. As shown in FIG. 2, the child seat assembly 70 includes a child seat 75 coupled to two base members 80 at hinge joints 85. The illustrated hinge joints 85 at least partially define a second or child pivot axis 86 and a translational axis 88 (FIG. 1), which is substantially perpendicular to the child pivot axis 86, discussed in more detail below. The illustrated child seat 75 includes a child support surface 90 adapted to support a child above the toilet bowl 32 with the child support surface 90 forming a child seat opening 95, which is smaller in area than the adult seat opening 40. A pair of arms 100 extends from the child support surface 90 in a rearward direction away from the child seat opening 95 with each arm 100 having a first portion 105 and a second portion 110. With reference to FIGS. 2 and 3, the first portion 105 is wider than the second portion 110 in a direction along the child pivot axis 86. Each second portion 110 includes a substantially cylindrical protrusion 115 having an outer circumferential surface 120 extending parallel to the child pivot axis 86 so that the protrusions 115 extend toward each other. In other embodiments, the protrusions 115 can be positioned on opposite sides of the second portions 110 to extend away from each other. Each illustrated protrusion 115 includes a notch 130 that opens in a direction substantially opposite the child support surface 90 and the corresponding arm 100. Also, each arm 100 includes a holding member 135 (e.g., a lip or an edge) protruding below each arm 100 (FIG. 3) and positioned at an end of the first portion 105 opposite the child support surface 90. In the illustrated embodiment, each holding member 135 extends at a greater distance toward the opposite arm 100 than does the protrusion 115 positioned adjacent each holding member 135 (e.g., at least a portion of the holding members 135 are positioned between the protrusions 115 in a direction parallel to the child pivot axis 86; FIG. 3). In other embodiments, the protrusions 115 can be positioned between the two holding members 135 in a direction parallel to the child pivot axis 86.

With continued reference to FIGS. 2 and 3, each base member 80 includes a top wall 140, a bottom wall 145 opposite the top wall 140, a front wall 150, a side wall 155, and an open side 160 opposite the side wall 155 that permits access to an inner cavity 165 of each base member 80. In other embodiments, the two base members 80 can be combined as one base member. The illustrated side wall 155 includes an oblong oval-shaped projection 170 defining a protrusion cavity or recess 175 with a tab 180 protruding into the protrusion cavity 175. In particular, the tab 180 is located within a bottom portion 185 of the protrusion cavity 175 and extends toward a top portion 190 of the protrusion cavity 175 (FIG. 3). In other embodiments, the projection 170 can be of a different shape (e.g., circular, triangular, rectangular, etc.). In further embodiments, a portion of the side wall 155 within the oval-shaped projection 170 can be omitted so that the protrusion cavity 175 is in communication with the inner cavity 165.

The illustrated top wall 140 includes a step 195 positioned between a support surface 200 of the top wall 140 and the front wall 150. In the illustrated embodiment, the front wall 150 at least partially defines a curved surface. In other embodiments, the front wall 150 can include a plurality of planar surfaces angled relative to each other to define a generally curved front wall. In the illustrated embodiment, a lip 205 (FIGS. 3 and 4) is coupled to the top wall 140 and extends away from the support surface 200 toward the bottom wall 145. In other embodiments, the top wall 140, the bottom wall 145, and/or the front wall 150 can include the lip 205. Each illustrated base member 80 also includes a finger 210 coupled to the bottom wall 145 extending away from the front wall 150 so that the oval-shaped projection 170 is positioned between the front wall 150 and the finger 210. In one embodiment, the finger 210 is configured to resiliently flex or move relative to the support surface 200 as to open or close a gap 215 positioned between the finger 210 and the support surface 200. In other embodiments, the finger 210 can be fixed relative to the support surface 200. In other embodiments, the base members 80 can include the protrusions 115 and the arms 100 can include the projections 170, the protrusion cavities 175, and the tabs 180.

To couple the child seat assembly 70 to the adult seat assembly 10, the base members 80 are selectively coupled to the lid 20 (FIG. 4) so that the base members 80 move with the lid 20 about the adult pivot axis 30. In one embodiment, the base members 80 are moved substantially parallel to the adult pivot axis 30 to be coupled to the arms 65. In particular, the edge 55 of the lid 20 is positioned within each gap 215 so that each finger 210 is adjacent the top surface 50 of the lid 20 and an end 220 of each top wall 140 is adjacent the bottom surface 45 of the lid 20. By sliding the base members 80 relative to the arms 65, the open side 160 of each base member 80 receives the arms 65 for the arms 65 to be located within the inner cavity 165 of each base member 80. As each arm 65 is received by one base member 80, the open side 160 flexes open to provide enough clearance between the lip 205 and the bottom wall 145 for each arm 65 to slide between the lip 205 and the bottom wall 145. Once each arm 65 is fully received within the inner cavity 165, the open side 160 resiliently moves back to an original state so that the lip 205 holds the base member 80 to the corresponding arm 65 (e.g., inhibits movement of the base members 80 relative to the arms 65 in a direction substantially parallel to the adult pivot axis 30). In some embodiments, the finger 210 can contact the top surface 50 and the end 220 can contact the bottom surface 45. As a result, the fingers 210 and the ends 220 also hold the base members 80 to the lid 20 by each finger 210 providing a pinching force acting on the lid 20 against the end 220 of the top wall 140 (e.g., inhibits movement of the base members 80 relative to the arms 65 in a direction substantially perpendicular to the adult pivot axis 30). In another embodiment, the base members 80 can slide onto the arms 65 in the direction substantially perpendicular to the adult pivot axis 30, rather than sliding onto the arms 65 in the direction substantially parallel to the adult pivot axis 30.

In other embodiments, the base members 80 can be integrally formed with the lid 20 (e.g., each base member 80 being formed as one-piece with one arm 65). In further embodiments, the base members 80 can be coupled to the lid 20 but spaced from the arms 65 (e.g., the base members 80 can be coupled to the bottom surface 45, the top surface 50, and/or the edge 55 of the lid 20). In yet further embodiments, the base members 80 can be coupled to at least one of the hinge posts 25 and the adult seat 15. In still yet further embodiments, the base members 80 can be shaped differently to couple to different types/styles of the adult toilet seat assembly 10.

Figure 6:
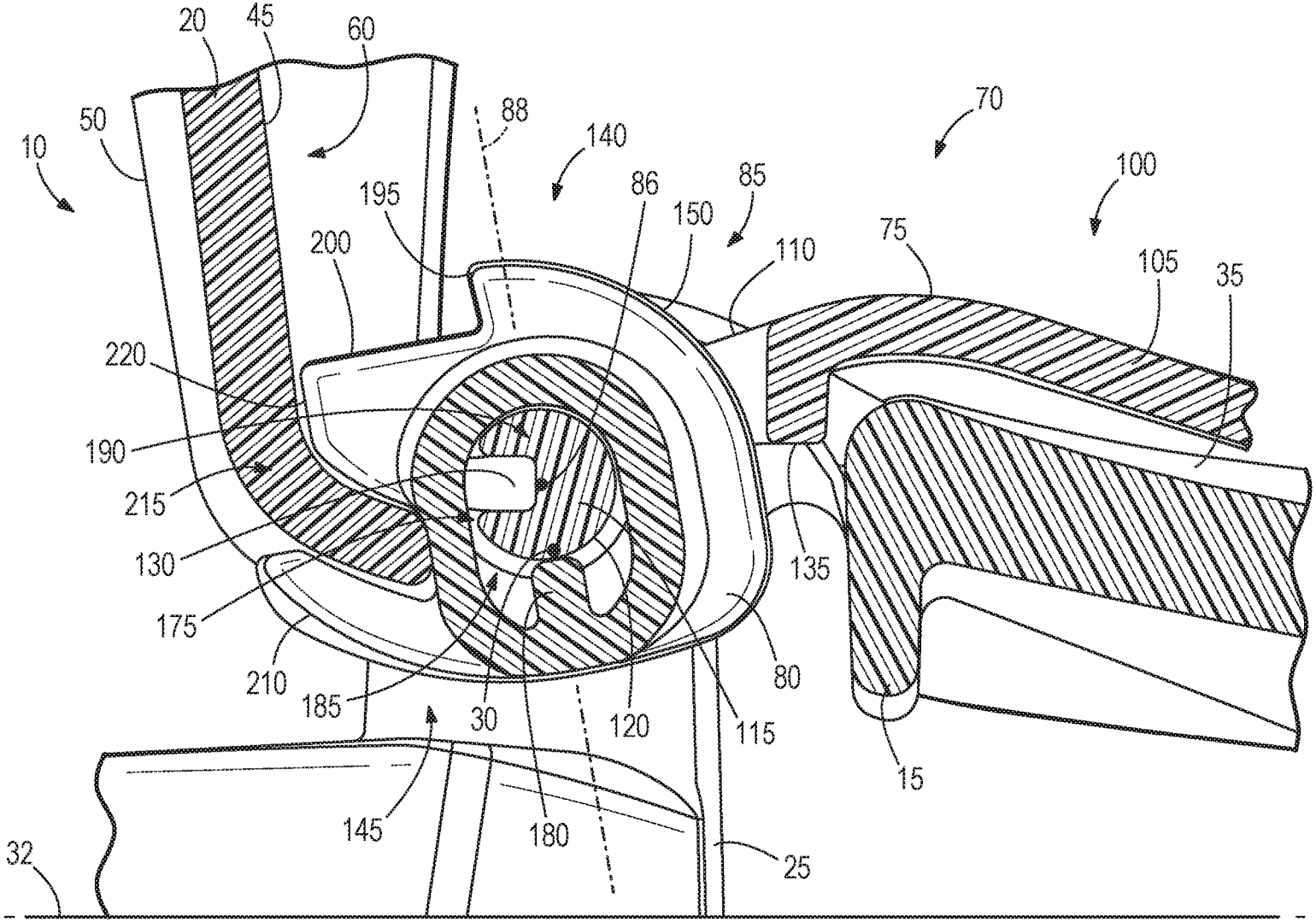
FIG. 6 is a cross sectional view of a portion of the toilet seat system taken along section line 6-6 of FIG. 1 illustrating an unlocked state of the child toilet seat assembly when the child toilet seat assembly is in the operating position.
Figure 7:
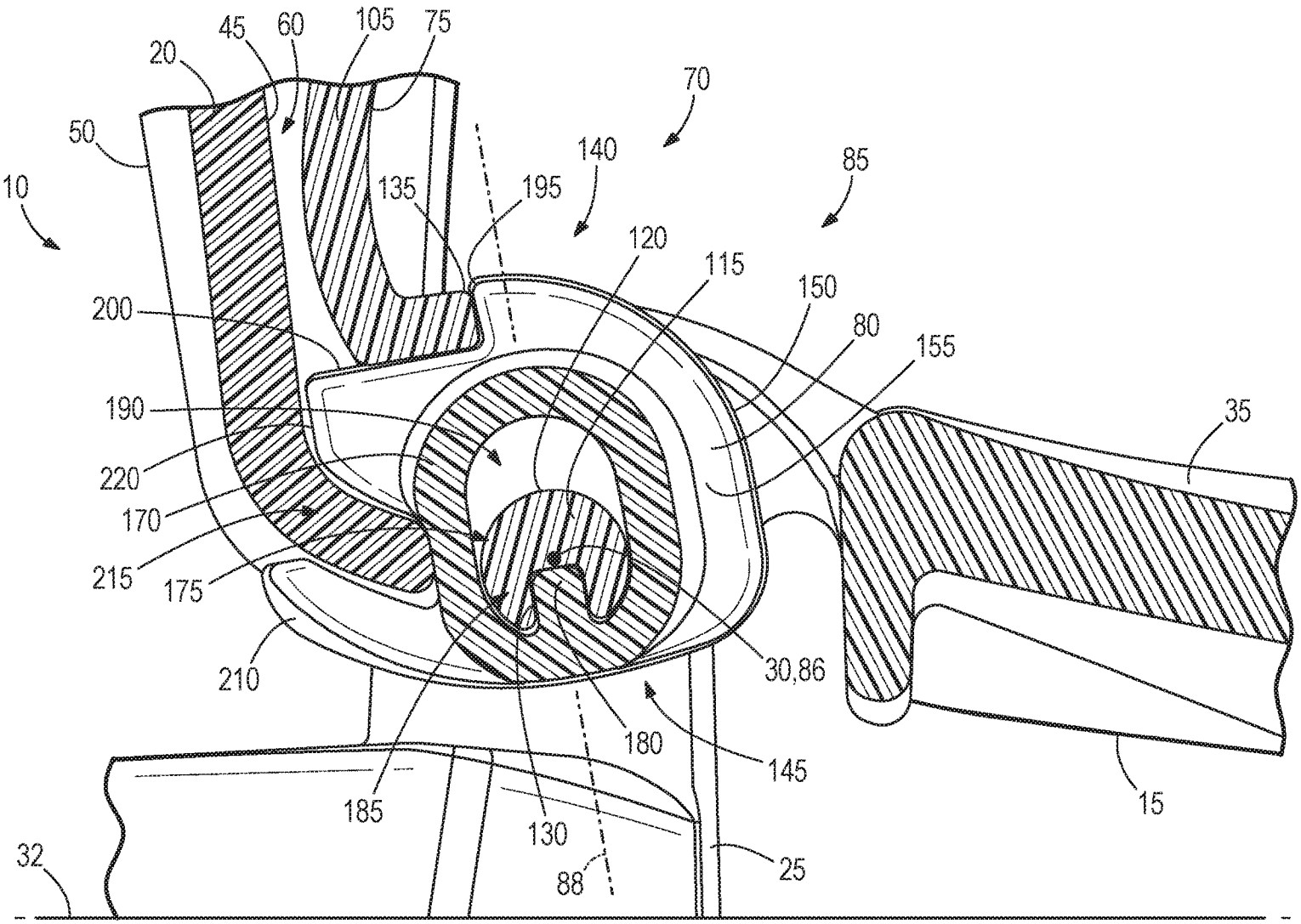
FIG. 7 is a cross sectional view of a portion of the toilet seat system taken along section line 7-7 of FIG. 5 illustrating a locked state of the child toilet seat assembly when the child toilet seat assembly is in the storage position.
Figure 8:
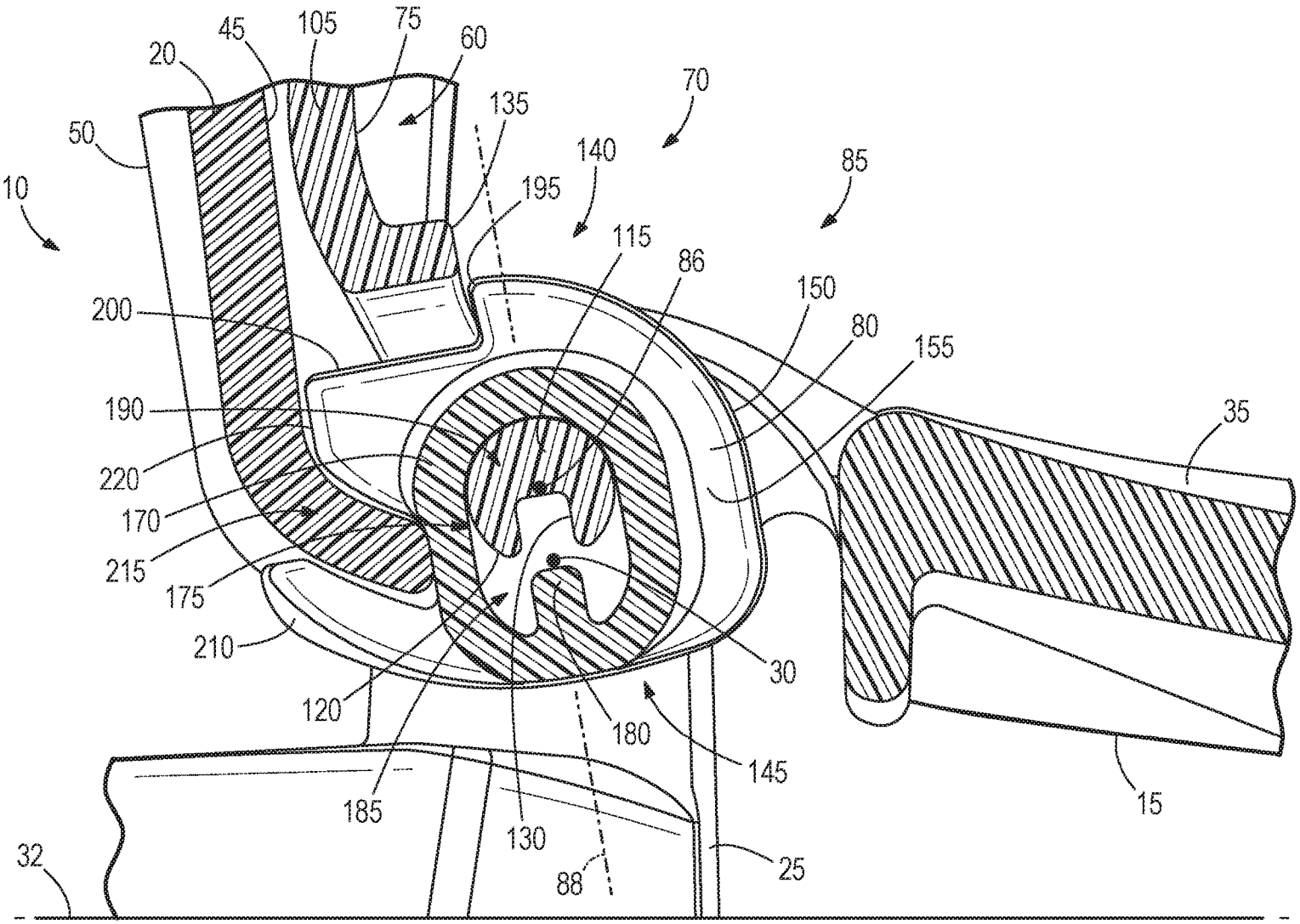
FIG. 8 is a cross sectional view of a portion of the toilet seat system taken along section line 7-7 of FIG. 5 illustrating the unlocked state of the child toilet seat assembly when the child toilet seat assembly is in the storage position.

With reference to FIGS. 1 and 6, the child seat 75 is selectively coupled to the base members 80—and ultimately the lid 20—by positioning each protrusion 115 within a corresponding protrusion cavity 175. In particular, the arms 100 of the child seat 75 (e.g., the second portions 110) are configured to flex away from each other to provide enough clearance for the protrusions 115 to be moved over the oval-shaped projections 170 and into the protrusion cavities 175. Without the tabs 180 of the base members 80 received within the notches 130 of the child seat 75, the child seat 75 is in an unlocked or moveable state relative to the lid 20 allowing the child seat 75 to pivot about the child pivot axis 86 between an operating position (FIGS. 1 and 6) and a storage position (FIGS. 5, 7, and 8). In other embodiments, the child seat 75 can be connected to the base members 80 before the base members 80 are connected to the lid 20.

In the operating position (FIGS. 1 and 6), the lid 20 is in an open position and the child seat 75 abuts the adult support surface 35 as the adult seat 15 abuts the toilet bowl 32. With particular reference to FIG. 6, the tabs 180 of the base members 80 abut the outer circumferential surface 120 of the protrusions 115 (e.g., the tabs 180 are not received within the notches 130 when the child seat 75 is in the operating position) to position the protrusions 115 within the top portion 190 of the protrusion cavity 175. When the child seat 75 is in the operating position, the child pivot axis 86 and the adult pivot axis 30 are non-collinear (FIG. 6). In other words, the child pivot axis 86 and the adult pivot axis 30 are spaced apart from each other.

When the child seat 75 moves from the operating position to the storage position (either by manually lifting the child seat 75 or the adult seat 15 toward the lid 20), sliding engagement between the outer circumferential surface 120 and the tab 180 allows the child seat 75 to rotate about the child pivot axis 86. Once the notches 130 align with the tabs 180, the child seat 75 is allowed to move downwardly along the translational axis 88 into the bottom portion 185 of the protrusion cavities 175 for the notches 130 to receive the tabs 180. Also, the holding members 135 abut the steps 195 and the support surfaces 200 (FIG. 7). As a result, the child seat 75 is in a locked or fixed state relative to the lid 20 as the engagement between the tabs 180 and the notches 130 as well as the engagement between the holding members 135 and the step 195 inhibit pivotable movement of the child seat 75 relative to the lid 20. In other embodiments, the tabs 180 can be coupled to the protrusions 115 of the child seat 75 and the notches 130 can be formed in the base members 80. In further embodiments, one of the holding members 135/steps 195 and the tabs 180/notches 130 can be omitted such that the other one of the holding members 135/steps 195 and the tabs 180/notches 130 function to hold the child seat 75 in the locked state. In yet further embodiments, the top walls 140 of the base members 80 can include a recess that receives a portion (e.g., an edge) of the arms 100 to hold the child seat 75 in the locked state.

Moreover, when the child seat 75 moves into the locked state, the child pivot axis 86 moves to be substantially collinear with the adult pivot axis 30 (FIG. 7). Accordingly, the lid 20, the base members 80, and the child seat 75 are movable together about the adult pivot axis 30. For example, by lifting the lid 20 from a closed position (not shown) into the open position, the child toilet seat 75 automatically moves with the lid 20 into the storage position as shown in FIG. 5.

To move the child seat 75 from the locked state (FIG. 7) to the unlocked state (FIG. 8) to again move the child seat 75 into the operating position (FIG. 1), the child seat 75 is lifted away from the base members 80 in a direction along the translational axis 88 for the child pivot axis 86 to move away from the adult pivot axis 30. As such, the protrusions 115 slide within the corresponding protrusion cavity 175 allowing the tabs 180 to disengage the notches 130 and the holding members 135 to clear the steps 195 (FIG. 8). Thereafter, the child seat 75 can be rotated back into the operating position (FIG. 1). The illustrated hinge joints 85 enable movement of the child seat 75 about the child pivot axis 86, about the adult pivot axis 30, and along the translational axis 88.

In sum, the child toilet seat 75 is pivotable relative to the adult seat 15 and the lid 20 about the child pivot axis 86 between the operating position (FIGS. 1 and 6) and the storage position (FIGS. 5 and 7). The child toilet seat 75 is also moveable along the translational axis 88 relative to the adult seat 15 and the lid 20 between the locked state (FIG. 7) inhibiting pivotable movement of the child toilet seat 75 relative to the lid 20 and the unlocked state (FIG. 8) allowing pivotable movement of the child toilet seat 75 relative to the lid 20. When in the locked state (FIG. 7), the child toilet seat 75 is also pivotable with the lid 20 about the adult pivot axis 30.

Although the invention has been described in detail with reference to certain preferred embodiments, variations and modifications exist within the scope and spirit of one or more independent aspects of the invention as described. Various features and advantages of the disclosure are set forth in the following claims.

The invention claimed is:

1. A child toilet seat assembly comprising:

a base member configured to be coupled to an adult toilet seat assembly having an adult toilet seat and a lid pivotably coupled to a hinge post; and a child toilet seat coupled to the base member via a hinge joint, the hinge joint enables the child toilet seat to pivot about a pivot axis between an operating position and a storage position, the hinge joint also enables the child toilet seat to move along a translational axis between a locked state inhibiting movement of the child toilet seat relative to the base member and an unlocked state allowing movement of the child toilet seat relative to the base member;

wherein the child toilet seat is configured to automatically move with the lid into the storage position by lifting the lid.

2. The child toilet seat assembly of claim 1, wherein the base member is configured to be coupled to the lid of the adult toilet seat assembly.

3. The child toilet seat assembly of claim 2, wherein the base member is configured to be selectively coupled to the lid.

4. The child toilet seat assembly of claim 1, wherein the pivot axis is a child seat pivot axis, wherein the child toilet seat is configured to pivot about the child seat pivot axis when the child toilet seat is in the unlocked state, and wherein the child toilet seat is configured to pivot about an adult seat pivot axis that is non-collinear with the child seat pivot axis when the child toilet seat is in the locked state.

5. The child toilet seat assembly of claim 1, wherein the hinge joint includes a protrusion formed on one of the base member and the child toilet seat, wherein the hinge joint also includes a recess formed in the other one of the base member and the child toilet seat, and wherein the protrusion is received within the recess enabling the child toilet seat to pivot about the pivot axis and to move along the translational axis.

6. The child toilet seat assembly of claim 5, wherein one of the protrusion and the recess includes a tab, wherein the other one of the protrusion and the recess includes a notch, wherein the tab is received within the notch when the child toilet seat is in the locked state, and wherein the tab is spaced from the notch when the child toilet seat is in the unlocked state.

7. The child toilet seat assembly of claim 6, wherein the base member includes a step and the child toilet seat includes a lip, wherein the lip is engageable with the step when the child toilet seat is in the locked state, and wherein the lip is spaced from the step when the child toilet seat is in the unlocked state.

8. The child toilet seat assembly of claim 5, wherein the base member includes a step and the child toilet seat includes a lip, wherein the lip is engageable with the step when the child toilet seat is in the locked state, and wherein the lip is spaced from the step when the child toilet seat is in the unlocked state.

9. The child toilet seat assembly of claim 1, wherein the child toilet seat is moved away from the base member to move the child toilet seat from the locked state to the unlocked state.

10. A child toilet seat assembly comprising:

a base member configured to be coupled to an adult toilet seat assembly having an adult toilet seat and a lid pivotably coupled to a hinge post;

a child toilet seat including a support surface configured to support a person;

a protrusion coupled to one of the base member and the child toilet seat; and a recess formed within the other one of the base member and the child toilet seat;

wherein the protrusion is received within the recess enabling the child toilet seat to pivot about a pivot axis relative to the base member between an operating position and a storage position, and wherein the protrusion is slidable within the recess between a locked state inhibiting movement of the child toilet seat relative to the base member and an unlocked state allowing movement of the child toilet seat relative to the base member;

wherein the pivot axis is a child seat pivot axis, wherein the child toilet seat is configured to pivot about the child seat pivot axis when the child toilet seat is in the unlocked state, and wherein the child toilet seat is configured to pivot about an adult seat pivot axis when the child toilet seat is in the locked state.

11. The child toilet seat assembly of claim 10, wherein the base member is configured to be coupled to the lid of the adult toilet seat assembly.

12. The child toilet seat assembly of claim 11, wherein the base member is configured to be selectively coupled to the lid.

13. The child toilet seat assembly of claim 10, wherein one of the protrusion and the recess includes a tab, wherein the other one of the protrusion and the recess includes a notch, wherein the tab is received within the notch when the child toilet seat is in the locked state, and wherein the tab is spaced from the notch when the child toilet seat is in the unlocked state.

14. The child toilet seat assembly of claim 10, wherein the base member includes a step and the child toilet seat includes a lip, wherein the lip is engageable with the step when the child toilet seat is in the locked state, and wherein the lip is spaced from the step when the child toilet seat is in the unlocked state.

15. A toilet seat system comprising:

an adult toilet seat pivotable about a first pivot axis;

a lid pivotable about the first pivot axis;

a child toilet seat pivotable about a second pivot axis different than the first axis between an operating position and a storage position, the child toilet seat also moveable along a translational axis between a locked state inhibiting pivotable movement of the child toilet seat relative to the lid and an unlocked state allowing pivotable movement of the child toilet seat relative to the lid; and a base member coupled to the lid and the child toilet seat, wherein the base member and the child toilet seat define a hinge joint enabling the child toilet seat to move about the first pivot axis, the second pivot axis, and along the translational axis.

16. The toilet seat system of claim 15, wherein the child toilet seat is configured to pivot about the first pivot axis when the child toilet seat is in the locked state, and wherein the child toilet seat is configured to pivot about the second pivot axis when the child toilet seat is in the unlocked state.

17. The toilet seat system of claim 15, wherein the hinge joint includes a protrusion formed on one of the base member and the child toilet seat, wherein the hinge joint also includes a recess formed in the other one of the base member and the child toilet seat, and wherein the protrusion is received within the recess.

18. The toilet seat system of claim 17, wherein one of the protrusion and the recess includes a tab, wherein the other one of the protrusion and the recess includes a notch, wherein the tab is received within the notch when the child toilet seat is in the locked state, and wherein the tab is spaced from the notch when the child toilet seat is in the unlocked state.

19. A child toilet seat assembly comprising:

a base member configured to be coupled to an adult toilet seat assembly having an adult toilet seat and a lid pivotably coupled to a hinge post; and a child toilet seat coupled to the base member via a hinge joint, the hinge joint enables the child toilet seat to pivot about a pivot axis between an operating position and a storage position, the hinge joint also enables the child toilet seat to move along a translational axis between a locked state inhibiting movement of the child toilet seat relative to the base member and an unlocked state allowing movement of the child toilet seat relative to the base member;

wherein the pivot axis is a child seat pivot axis, wherein the child toilet seat is configured to pivot about the child seat pivot axis when the child toilet seat is in the unlocked state, and wherein the child toilet seat is configured to pivot about an adult seat pivot axis that is non-collinear with the child seat pivot axis when the child toilet seat is in the locked state.

20. A child toilet seat assembly comprising:

a base member configured to be coupled to an adult toilet seat assembly having an adult toilet seat and a lid pivotably coupled to a hinge post; and a child toilet seat coupled to the base member via a hinge joint, the hinge joint enables the child toilet seat to pivot about a pivot axis between an operating position and a storage position, the hinge joint also enables the child toilet seat to move along a translational axis between a locked state inhibiting movement of the child toilet seat relative to the base member and an unlocked state allowing movement of the child toilet seat relative to the base member;

wherein the hinge joint includes a protrusion formed on one of the base member and the child toilet seat, wherein the hinge joint also includes a recess formed in the other one of the base member and the child toilet seat, and wherein the protrusion is received within the recess enabling the child toilet seat to pivot about the pivot axis and to move along the translational axis;

wherein one of the protrusion and the recess includes a tab, wherein the other one of the protrusion and the recess includes a notch, wherein the tab is received within the notch when the child toilet seat is in the locked state, and wherein the tab is spaced from the notch when the child toilet seat is in the unlocked state.

21. A child toilet seat assembly comprising:

a base member configured to be coupled to an adult toilet seat assembly having an adult toilet seat and a lid pivotably coupled to a hinge post; and a child toilet seat coupled to the base member via a hinge joint, the hinge joint enables the child toilet seat to pivot about a pivot axis between an operating position and a storage position, the hinge joint also enables the child toilet seat to move along a translational axis between a locked state inhibiting movement of the child toilet seat relative to the base member and an unlocked state allowing movement of the child toilet seat relative to the base member;

wherein the hinge joint includes a protrusion formed on one of the base member and the child toilet seat, wherein the hinge joint also includes a recess formed in the other one of the base member and the child toilet seat, and wherein the protrusion is received within the recess enabling the child toilet seat to pivot about the pivot axis and to move along the translational axis;

wherein the base member includes a step and the child toilet seat includes a lip, wherein the lip is engageable with the step when the child toilet seat is in the locked state, and wherein the lip is spaced from the step when the child toilet seat is in the unlocked state.

22. A child toilet seat assembly comprising:

a base member configured to be coupled to an adult toilet seat assembly having an adult toilet seat and a lid pivotably coupled to a hinge post;

a child toilet seat including a support surface configured to support a person;

a protrusion coupled to one of the base member and the child toilet seat; and a recess formed within the other one of the base member and the child toilet seat;

wherein the protrusion is received within the recess enabling the child toilet seat to pivot about a pivot axis relative to the base member between an operating position and a storage position, and wherein the protrusion is slidable within the recess between a locked state inhibiting movement of the child toilet seat relative to the base member and an unlocked state allowing movement of the child toilet seat relative to the base member;

wherein one of the protrusion and the recess includes a tab, wherein the other one of the protrusion and the recess includes a notch, wherein the tab is received within the notch when the child toilet seat is in the locked state, and wherein the tab is spaced from the notch when the child toilet seat is in the unlocked state.

23. A child toilet seat assembly comprising:

a base member configured to be coupled to an adult toilet seat assembly having an adult toilet seat and a lid pivotably coupled to a hinge post;

a child toilet seat including a support surface configured to support a person;

a protrusion coupled to one of the base member and the child toilet seat; and a recess formed within the other one of the base member and the child toilet seat;

wherein the protrusion is received within the recess enabling the child toilet seat to pivot about a pivot axis relative to the base member between an operating position and a storage position, and wherein the protrusion is slidable within the recess between a locked state inhibiting movement of the child toilet seat relative to the base member and an unlocked state allowing movement of the child toilet seat relative to the base member;

wherein the base member includes a step and the child toilet seat includes a lip, wherein the lip is engageable with the step when the child toilet seat is in the locked state, and wherein the lip is spaced from the step when the child toilet seat is in the unlocked state.

* * * * *